United States Patent [19]

Ishii

[11] 3,986,018

[45] Oct. 12, 1976

[54] LIGHT SOURCE DEVICE

[75] Inventor: Takao Ishii, Himeji, Japan

[73] Assignee: Ushio Electric Inc., Tokyo, Japan

[22] Filed: Oct. 15, 1975

[21] Appl. No.: 622,670

[30] Foreign Application Priority Data

Oct. 15, 1974 Japan ..... 49-123537
Mar. 6, 1975 Japan ..... 50-26481

[52] U.S. Cl. ..... 240/47; 240/11.4 R; 355/67

[51] Int. Cl.[2] ..... F21V 29/00

[58] Field of Search ..... 240/47, 11.4 R; 355/67; 352/202

[56] References Cited

UNITED STATES PATENTS 1,241,098 9/1917 Doyle et al. ..... 240/47
3,258,587 6/1966 Segil ..... 240/47
3,265,885 8/1966 Porter ..... 240/47

*Primary Examiner*—Monroe H. Hayes
*Attorney, Agent, or Firm*—James E. Nilles

[57] ABSTRACT

A light source device including an elongated box-shaped house, a gutter-shaped reflex mirror having a slit at its bottom and an elongated tubular light source positioned in the vicinity of said slit to effectively cool the bulb wall portion of said light source on the downstream side of a cooling flow generated by the cooling means disposed on the back wall of said house.

4 Claims, 10 Drawing Figures

LIGHT SOURCE DEVICE

The present invention relates to a light source device having a high power consumption light source and more particularly to a light source device having a tubular elongated high pressure mercury-arc lamp, which has a high power consumption and thermal load.

Tubular elongated high pressure lamps, which are used for a high power consumption light source such as the light source for a diazo wet type copying machine, have hitherto been utilized in a wide field because they have many advantages due to their wide spectral distribution which extends from the ultraviolet region to the visible region. Accordingly, attempts have been made to utilize the high pressure mercury-arc lamp as a typical artificial light source during production processes or for pollution prevention.

Such a light source is not used as it is, however, but used while it is encased in a lamp house. In case of a light source device having a high power consumption light source, the inside of said light source device becomes very cramped because it contains a cooling blower, mirror, shutter and accessories. Further, demands have been made to develop a smaller light source device having a high power consumption light source and to speed up the production process of articles for industrial use. For example, a smaller light source device for drying ultraviolet hardened type printing ink has been developed to employ a high power consumption light source.

Up to date, a more preferable light source device for drying ultraviolet hardened type printing ink has not yet been completed for many reasons. It was found by the inventor that in a light source device having a tubular elongated high power consumption light source, more particularly, a tubular elongated high pressure mercury-arc lamp, which has a high thermal load and into which electrical input energy is more than 90 watt per 1 cm of arc, the temperature distribution at the bulb wall becomes remarkably uneven and the bulb wall is liable to be locally broken by generation of large thermal stress.

Referring to FIG. 1 and FIG. 2, a light source device normally comprises a house 1, a blower 4 on the back wall of a house 1, a gutter-shaped mirror divided into two sections 2*a* – 2*b* and a light source 3 such as a tubular elongated high pressure mercury-arc lamp within a house 1. A light source 3 is cooled centering around the center of said light source 3 by a cooling wind only directed at a right angle to the axis of said light source 3. Accordingly, as shown in FIG. 3, the cooling effect at a portion 3*a* of the bulb wall on the upstream side of the cooling wind becomes high, but at a portion 3*b* on the downstream side of the wind becomes low. This is because the angle $\theta$ showing the degree of the turn of the cooling flow X of the wind around the bulb wall is about 20 without being effected by the wind velocity and therefore vortexes 10 are generated in the vicinity of said portion 3*b*. According to our experiments, the temperature distribution on the bulb wall of a light source 3 which is a tubular elongated high pressure mercury-arc lamp energized more than 90 watt per 1 cm of arc within the conventional device as shown in FIG. 1, is remarkably uneven as shown in FIG. 4.

Generally, if the high power consumption light source is made smaller, the bulb wall load of the light source increases, so that the thermal load of the bulb wall becomes high and a stronger cooling flow is needed. If a cooling flow is stronger, portion 3*a*, however, is over cooled, and then a light of predetermined large capacity cannot be obtained because the mercury in the light source fails to vaporize fully. On the contrary, portion 3*b* is not cooled fully because of the small angle, and then the bulb wall is liable to be locally broken by generation of large thermal stresses. According to the above reasons, a preferable light source device for drying ultraviolet hardened type printing ink has not yet been completed. That is to say, it is not enough to cool strongly the bulb wall where the thermal load of the bulb is high, but necessary to adopt a suitable cooling flow for the light source.

One object of the present invention is to provide a smaller light source device having a high power consumption light source such as a tubular elongated light source, wherein the bulb wall of the light source is evenly cooled to prevent local damage to its bulb wall and to enable the light source to emit a light of predetermined large capacity.

Another object of the present invention is to provide a smaller light source device having a tubular elongated high pressure mercury-arc lamp, wherein said lamp has an electrical input power more than 90 watt per 1 cm of arc for servicing to dry ultraviolet hardened type printing ink.

Still another object of this invention will become apparent from the following description when taken in conjunction with the accompanying drawings, in which.

Figure 1:
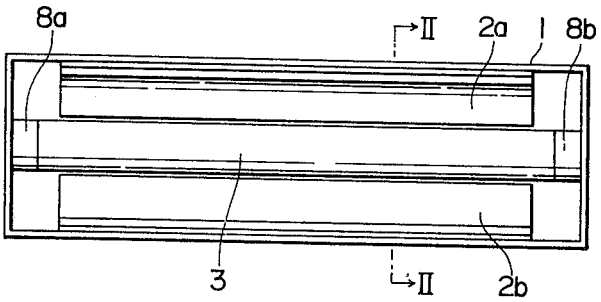
FIG. 1 is a front view of a conventional light source device.
Figure 2:
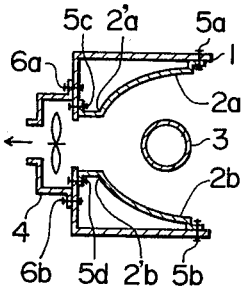
FIG. 2 is a view in section taken on the line II—II of FIG. 1.
Figure 3:
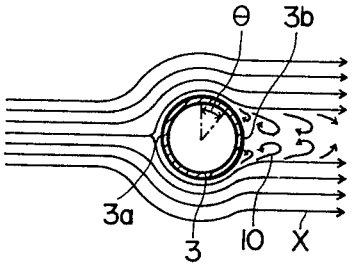
FIG. 3 is a schematic view of a cooling flow within the conventional light source device.
Figure 4:
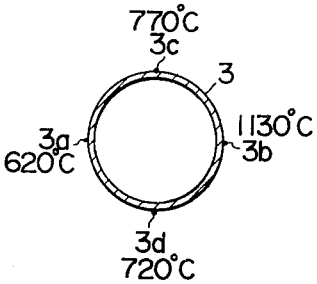
FIG. 4 is a schematic view of the temperature distribution on the bulb wall of a light source within the conventional device.

In FIGS. 1 and 2 which show the conventional device, reference numeral 1 designates an elongated box-shaped house. 2*a* and 2*b* designate each sections of divided mirror respectively, fixed on the inside wall of said house 1 by means of volts 5*a*, 5*b*, 5*c* and 5*d* etc. 3 is a tubular elongated light source supported by holding means 8*a* and 8*b* which in turn are supported on the side wall of a house 1. 4 is a blower positioned on the back wall of a house 1 by means of volts 6*a* and 6*b* etc. so as to cool said light source 3.

Figure 5:
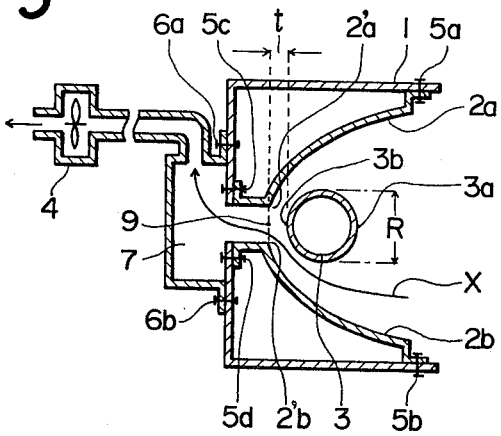
FIG. 5 is a sectional view of the present invention drawn in the same way as FIG. 2.

In the present invention as shown in FIG. 5, a gutter-shaped reflex mirror which is divided into two parts 2*a*

Figure 6:
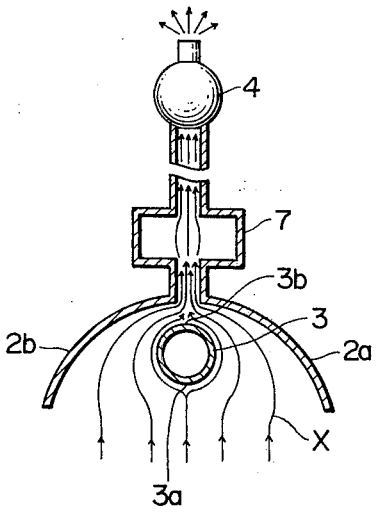
FIG. 6 is a schematic view of a cooling flow within the present invention.

– 2*b* are arranged in parallel with an elongated tubular light source 3 such as a high pressure mercury-arc lamp within and along the longitudinal direction of an elongated box-shaped house 1. A cooling flow X is led through a slit formed at the bottom 2'a – 2'b of a mirror 2a – 2b, cooling the bulb wall of a light source 3 closely near a slit. Therefore, two parts of a cooling flow along the surface of the bulb wall and the mirror join in the vicinity of the bulb wall portion 3b so that a vortex 10 disappears as shown in FIG. 6. A duct 7 is provided on the back wall of said house 1 for connecting a blower 4 and a slit 9 if it is necessary.

Figure 8:
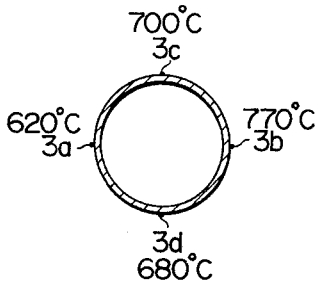
FIG. 8 is a schematic view of the temperature distribution on the bulb wall of a light source within the invented device.
Figure 7:
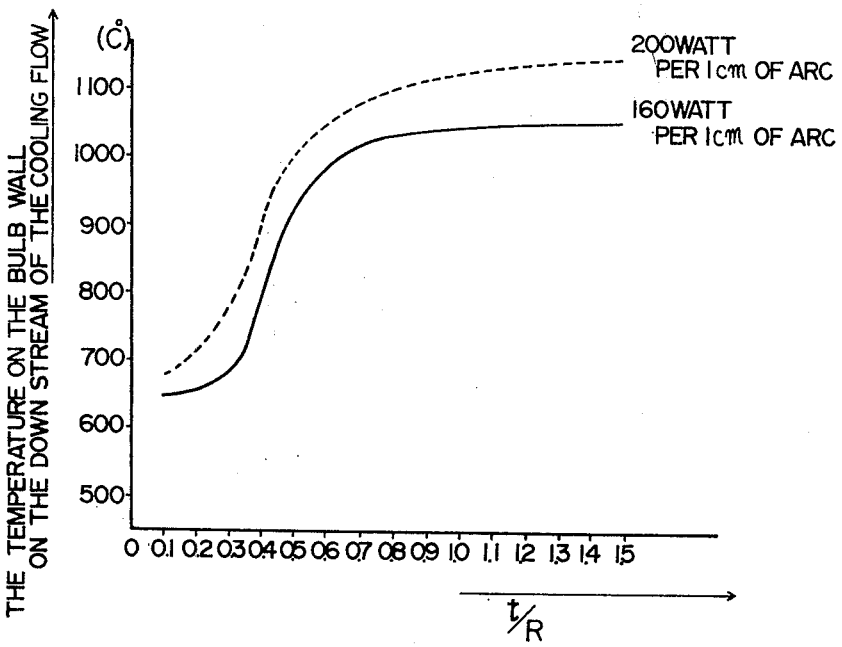
FIG. 7 is a graph illustrating the temperature of the bulb wall portion 3*b* on the downstream side of the cooling flow versus $t/R$.

FIG. 7 is a graph illustrating the data, in which the temperature of the bulb wall portion 3b of the high pressure mercury-arc lamp is plotted against $t/R$. $t$ designates the distance between a slit 9 and a bulb wall portion 3b on the downstream side of a cooling flow, and R the outer diameter of said lamp. A lamp above mentioned has 25 mm outer diameters and 1,105 mm arc length, which has an electrical input power of 200 watt or 160 watt per 1 cm of arc in condition that the cooling flow is 80 liters per minute at a slit. From the above data, it is concluded that the bulb wall portion 3b on the downstream side is cooled effectively within two-thirds and at the best effect within one-third as a value of $t/R$. The temperature distribution of the bulb wall of above mentioned lamp energized by 200 watt per 1 cm of arc in case of one-third as a value of $t/R$ is remarkably even as shown in FIG. 8.

Figure 9:
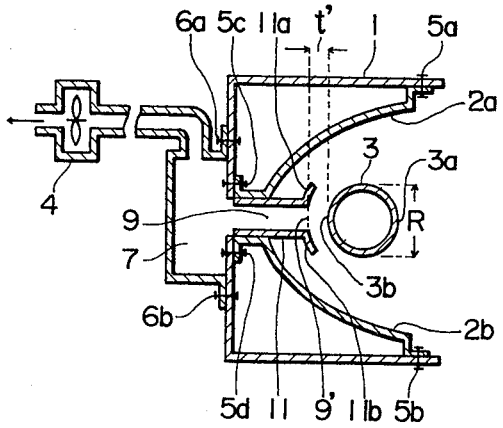
FIG. 9 is a sectional view of another embodiment of the present invention drawn in the same way as FIG. 2.

FIG. 9 shows another embodiment of the present invention. In this case, a wind channel 11 is provided on the bottom 2'a – 2'b of a mirror 2a – 2b and its opening 9' is positioned in the area within one-third as a value of $t'/R$. $t'$ is the distance between an opening 9' and a bulb wall portion 3b on the downstream side of a cooling flow. A wind channel 11 is very important in case that the desired light distribution on the surface of the object can be obtained when a light source 3 is positioned in the area without one-third as a value of $t/R$.

Figure 10:
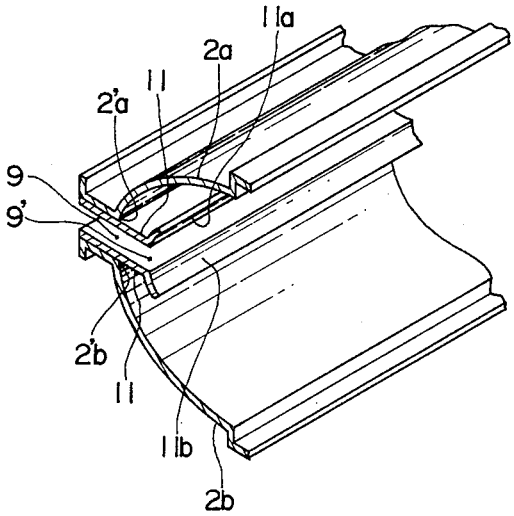
FIG. 10 is a birds-eye view for illustrating the mirror and the wind channel used in the device in FIG. 8.

A wind channel 11 is preferably assembled with a mirror 2a – 2b as shown in FIG. 10. 11a, 11b designate a small gutter covering a light source to easily regulate a cooling flow around the bulb wall of a light source 3.

As stated above, according to the present invention, a small light source device is completed and more particularly a smaller light source device having a tubular elongated mercury-arc lamp, wherein said lamp has an electrical input power more than 90 watt per 1 cm of arc for servicing to dry ultraviolet hardened type printing ink, is easily completed because portions of the bulb wall on the upstream side and downstream side of the cooling flow can be cooled uniformly and efficiently even when the light source is cooled strongly from one direction, thereby preventing the output of light from reduction because of over-cooling of the bulb wall on the upstream side of the cooling flow and preventing the bulb wall on the downstream side of the cooling flow from local damage.

What is claimed is:

1. A light source device comprising an elongated box-shaped housing, a cooling means provided on the back wall of said house, a gutter-shaped reflex mirror having a slit at its bottom and a tubular elongated light source arranged within and along the longitudinal direction of said housing, wherein said light source has an electrical input power more than 90 watt per 1 cm of arc and the distance between a slit and a bulb wall portion 3b of said light source on the downstream side of a cooling flow is within one-third of the outer diameter of said light source.

2. A light source device comprising an elongated box-shaped housing, a cooling means provided on the back wall of said house, a gutter-shaped reflex mirror having a slit at its bottom and a tubular elongated light source arranged within and along the longitudinal direction of said housing, and a wind channel having an opening provided between said slit and said light source, wherein said light source has an electrical input power more than 90 watt per 1 cm of arc and the distance between an opening of said wind channel and a bulb wall portion 3b of said light source on the downstream side of a cooling flow is within one-third of the outer diameter of said light source.

3. A device as claimed in claim 1, wherein said light source is a high pressure mercury-arc lamp.

4. A device as claimed in claim 2, wherein said light source is a high pressure mercury-arc lamp.

* * * * *